United States Patent [19]

Borbely

[11] 4,092,152

[45] May 30, 1978

[54] VOLATILIZATION OF IMPURITIES FROM SMELTER REVERTS

[75] Inventor: Gyula John Borbely, Copper Cliff, Canada

[73] Assignee: The International Nickel Company, Inc., New York, N.Y.

[21] Appl. No.: 821,470

[22] Filed: Aug. 3, 1977

[30] Foreign Application Priority Data

Apr. 25, 1977 Canada ..... 276851
May 12, 1975 Canada ..... 226684

Related U.S. Application Data

[63] Continuation-in-part of Ser. No. 669,854 Mar. 24, 1976, abandoned.

[51] Int. Cl.[2] ..... C22B 1/08

[52] U.S. Cl. ..... 75/7; 75/3; 75/25; 423/51; 423/60; 423/88; 423/96; 423/97; 423/107

[58] Field of Search ..... 75/1, 3, 4, 5, 6, 7, 75/8, 25, 82; 423/46, 59, 60, 51, 96, 88, 97, 107, 108, 110, 154, 491, 492, 494, 497

[56] References Cited

U.S. PATENT DOCUMENTS

| | | | |
|---|---|---|---|
| 1,107,310 | 8/1914 | Johnson | 75/6 |
| 1,299,560 | 4/1919 | Doerner | 423/60 |
| 2,756,136 | 7/1956 | Queneau | 75/5 |
| 2,848,314 | 8/1958 | Johannsen et al. | 75/9 |
| 3,401,032 | 9/1968 | Renzoni et al. | 75/1 |
| 3,466,167 | 9/1969 | Illis et al. | 75/1 |
| 3,466,169 | 9/1969 | Nowak et al. | 75/112 |
| 3,649,245 | 3/1972 | Colombo et al. | 75/9 |
| 3,758,293 | 9/1973 | Viviani et al. | 75/23 |
| 3,773,635 | 11/1973 | Kane et al. | 75/101 |

FOREIGN PATENT DOCUMENTS

| | | |
|---|---|---|
| 531,242 | 10/1956 | Canada. |
| 567,905 | 12/1958 | Canada. |
| 593,959 | 3/1960 | Canada. |

OTHER PUBLICATIONS

Ellingham, H. J. T.; "Reducibility of Oxides and Sulphides in Metallurgical Processes" *Jl. of the Society of Chemical Industry*, pp. 125-133 (5/44).

Kellogg, H. H.; "Thermodynamic Relationships In Chlorine Metallurgy", *Transactions AIME*, vol. 188, pp. 862-872, (6/50).

Othmer, D. F., et al.; "Halogen-Affinities—A New Ordering of Metals to Accomplish Difficult Separations", *AICHE Jl* vol. 18, pp. 217-220 (1/72).

*Primary Examiner*—L. Dewayne Rutledge
*Assistant Examiner*—Michael L. Lewis
*Attorney, Agent, or Firm*—W. A. Petersen; E. C. MacQueen

[57] ABSTRACT

A process for substantially reducing the presence of impurities from a sulfur-containing feed material such as dust and hydrometallurgical wastes that result from smelting and refining operations. Pelletized feed materials are heated to 800° to 1150° C and reacted with a gas stream containing chlorine and oxygen. In the presence of sulfur dioxide formed in situ and due to the presence of residual sulfur, the order of volatilization of the elements contained in the feed material is changed from that known for conventional chloridization processes to a more advantageous order. The elements Cd, Bi, Re, Pb, Mo, Sn, Sb, Zn, and As are volatilized and thereby separated from the solid feed material which is consequently enriched in Cu, Ag, Co, Fe, Ni, Au, and precious metals. The feed material is subsequently refined conventionally.

8 Claims, No Drawings

VOLATILIZATION OF IMPURITIES FROM SMELTER REVERTS

The present invention is a continuation-in-part of application Ser. No. 669,854, filed Mar. 24, 1976, now abandoned.

The invention relates to a process for separating the elements cadmium, bismuth, rhenium, lead, molybdenum, tin, antimony, zinc, and arsenic as volatile gases from the elements copper, silver, cobalt, iron, nickel, gold, and precious metals contained in a feed material. Selective reaction and volatilization of the first group of elements is accomplished because of the presence of specific quantities of sulfur dioxide in an oxygen-rich combusted gas containing controlled additions of chlorine.

Smelting and refining operations generate large quantities of dust and hydrometallurgical wastes which are collected and reverted to the smelter. Recycling of such materials, which are prone to contain elements potentially harmful to the final product, can lead to eventual buildup of the levels of these undesired elements in the feed and contamination of the final product. Thus, a need exists for a more effective means for separating contaminating constituents such as cadmium, bismuth, lead, etc., from such waste materials in order that they may be treated for recovery of the desired metallic values.

Chlorination is a well known process for separating various elements from their ores. Elements such as copper and lead form chlorides when contacted with chlorine at elevated temperatures. Such chlorides are highly volatile and can be separated readily in gaseous form from solid feed material. However, commercially used chlorination methods generally require that the ore or feed material be in an oxidized state, requiring costly intermediate roasting operation, prior to being brought into contact with chlorine gas.

The foremost use of chlorination is in the separation by volatilization of the elements copper, zinc, lead, and arsenic from ores containing nickel or iron. Such processes are conducted at temperatures of about 800° to 1300° C. There are variations on the basic process which are aimed at the selective volatilization of individual elements and subsequent recovery as well as a process in which all of the chlorinatible metallics are volatilized, collected, and fractionally distilled. One of the disadvantages of such processes is that the order in which the metallic elements are volatilized may not be entirely desirable for further processing and recovery of these elements.

Other methods, substantially different from those aforedescribed, do not involve volatilization. For example, in one technique a chloridized cinder is formed at a somewhat lower temperature, i.e., 200° to 500° C, from which the desired elements are recovered by leaching. The major problem inherent in such methods is the need for aqueous leaching which, with current requirements for purity of water effluent, entails considerable purification expense.

The order in which the elements are volatilized is a prime importance in all of the prior art processes. A published order of volatilization for metallic chlorides at 1000° C, starting with the most volatile element and ending with the least volatile element, follows: Ag, Hg, Pb, Cd, Cu, Mn, Ni, Zn, Sn, Fe, Mg, Cr, Ti, Al, Si. Based on this information, numerous processes have been devised for separating the various fractions and subsequently concentrating elements in the volatilized gas or in the residue. In many instances, it would be advantageous if the order of volatilization differed from the restrictions imposed by the natural order of volatilization.

It has now been discovered that the restrictive order of volatilization of the metallic elements known in conventional chlorination processes can be circumvented. Indeed, it has been found that the volatilization sequence can be advantageously rearranged by introduction of sulfur dioxide to the chlorinating gas stream. Sulfur dioxide may be formed in situ through reaction of excess oxygen with sulfur in the feed material or by intentional addition of sulfur dioxide to the chlorinating gas stream. In the presence of sulfur dioxide and sulfur, the order of volatilization is changed from that known and aforedescribed to the following sequence which includes those elements of importance to a currently used smelting and refining operation on a particular feed material: Cd, Bi, Re, Pb, Mo, Sn, Sb, Zn, As, Cu, Ag, Co, Fe, Ni, Au, and precious metals. Through control of processing conditions, elements forming chlorides having greater volatility than copper are removed from the feed material. The elements remaining behind as solids in the feed material are subsequently refined by conventional methods.

It is an object of this invention to provide a process for reducing most substantially the presence of at least one of the elements: cadmium, bismuth, rhenium, lead, molybdenum, tin, antimony, zinc, and arsenic from a feed material as volatile chlorides thereby leaving behind a material enriched in at least one of the elements copper, silver, cobalt, iron, nickel, gold, and precious metals better suited to conventional smelting and refining operations.

Generally speaking, the present invention is directed to a process for treating a finely divided residue containing at least about 1.5%, by weight, of sulfur and at least one metal value from the group consisting of copper, silver, cobalt, iron, nickel, gold, and precious metals to remove therefrom at least one impurity from the group consisting of Cd, Bi, Re, Pb, Mo, Sn, Sb, Zn, and As which comprises: pelletizing said residue; and heating said pelletized residue at a temperature of about 800° to about 1150° C in an atmosphere containing chlorine in an amount of about 0.1 percent to about 5 percent, by weight of charge weight, of said residue and about 8% to about 20% by volume of sulfur dioxide to volatilize said impurities and provide a treated residue containing at least about 1 weight percent sulfur enhanced in said metal value content. The sulfur in the finely-divided residue and the treated residue is sulfide sulfur and/or elemental sulfur.

Advantageously, the gaseous stream contains from about 2% to about 20% oxygen by volume of gas. Upon reaction with the sulfur, this results in about 8% to about 20% sulfur dioxide, by volume, in the gas stream. Below about 8% sulfur dioxide in the gas stream present in the reaction zone, the preferred volatilization order is not achieved while there is little advantageous increase in volatilization with sulfur dioxide contents above about 20%.

In carrying the invention into practice, it has been found that it is particularly effective when used to separate at least one of the elements cadmium, bismuth, rhenium, lead, molybdenum, tin, antimony, zinc, and arsenic as volatile chlorides from a feed material such as a finely divided residue containing electrostatic precipitator dusts and reverts from hydrometallurgical operations. It is preferred that such a feed material contain from about 2% to about 20% total sulfur, by weight, with at least about 2% of the sulfur being in the form of sulfide or elemental sulfur, which quantity is sufficient to react with oxygen in the gas stream and thus introduce the highly desirable sulfur dioxide level of 8 to 20%, by volume, into the gas stream. In the event that insufficient sulfur is present in a particular feed material, supplemental quantities of sulfur dioxide may be introduced within the gas stream.

Sulfates can serve as an additional source of sulfur dioxide by reaction with copper sulfide, and the following reduction reaction is believed to occur:

$$3CuSO_4 + CuS \rightarrow 4CuO + 4SO_2.$$

For efficient operation, it is essential that sufficient sulfur (as sulfide sulfur and/or elemental sulfur) be present in the feed material so that the amount of sulfate ($SO_4$), in weight percent, is less than about $$(\text{sulfur})/(0.3) - 4.$$

Advantageously, the process is carried out in a continuous fashion. A vertical shaft furnace was used for the processing described herein and is considered useful for this purpose; however, a rotary kiln, fluid bed roaster, or other suitable apparatus could also be used for this purpose.

The oxygen content within the reaction bed is of considerable importance to the principal reactions. Also, it has been found that in a highly-oxidizing, low-moisture atmosphere, accelerated volatilization of copper and arsenic occurs; however, in turn, the volatilization of bismuth and zinc is depressed. It is preferred that a sulfur dioxide to oxygen ratio of at least 1:1, and preferably at least 4:1, or even 10:1 or more, be maintained for optimum volatilization. Further in this regard, the moisture content of the combustion gas should be limited since increasing the water content decreases the volatilization of arsenic, zinc, and copper. It is preferred that the moisture content of the gas stream be maintained between 5% and 20% by volume.

Although theoretically only the stoichiometric quantity of chlorine required to form volatile chlorides of the impurity elements need be added, it has been found that a considerably greater quantity is required in practice. For feed materials of the type described herein, the presence of 3% chlorine, by weight of charge weight, in the gas stream is sufficient to lower all impurities to acceptable levels. It is preferred that the chlorine addition be maintained between about 1.2% and about 3.5%, and still more preferably between about 1.5% and 3.0% by weight of charge weight. It is preferred that chlorine be added as a gas although other sources of chlorine might be used. However, as found with HCl addition, other sources may not be as effective as gaseous chlorine.

Optimum volatilization conditions were achieved with a throughput time of 1½ to 2 hours. The temperature of the reaction bed should be controlled so that temperatures in excess of 1150° C are avoided since melting of the feed material may occur. The rate of reaction at temperatures below 800° C is too low to be of commercial interest. Generally, reaction bed temperatures between 925° C and 1050° C are preferred. The off-gases from the reactor are treated in a scrubbing system to remove the volatilized elemental chlorides, sulfur dioxide, and other contained gases. Impurities retained in the scrubbers can be recovered by conventional means.

For the purpose of giving those skilled in the art a better understanding of the invention, the following illustrative examples are given:

EXAMPLE I

A mixture of electrostatic precipitator dusts and reverts from hydrometallurgical operations were pelletized readily by the addition of about 20% by weight of water as a fine spray. The pellets were then dried at 110° C to a 5% moisture content and temporarily stored as feed stock. A pellet size of about minus 6 to about plus 30 mesh was used in the vertical shaft furnace. The pellets were fed at prescribed intervals into the top of a vertical shaft furnace which was constructed from a 5 centimeter diameter "Vycor" glass tube capped at both ends with fire-clay crucibles and fitted with inlet and outlet ports to handle solid and gas throughput. The shaft was heated in a vertically positioned furnace that was equipped with automatic heat control. Combustion gases, oxygen, and chlorine were fed in countercurrent flow to the solids. Off-gases from this reactor were treated in a two-stage scrubbing system consisting of a water scrubber and a scrubber containing 4N sodium hydroxide solution. Neutralized gas left the scrubbers through a regulator and vacuum pump.

The 24-hour continuous operation was started by heating a false charge of dead roasted pellets in the shaft. After the desired temperature was reached and conditions had stabilized, the flow of chlorinating gases was started and the scrubber system energized. Temperature was controlled at about 1000° C for the first 12 hours of the 24-hour run and subsequently reduced to about 925° C. The minus 6 to plus 35 mesh pellets were added at the rate of 60 milliliters every 15 minutes, which is equivalent to an average feed rate of 3.9 grams per minute with an average retention time of about 2 hours. The throughput of the gas mixture varied between 1900 and 2500 cubic centimeters/minute with excess oxygen content ranging from 2 to 20% by volume. Moisture and carbon dioxide were kept between about 6% and 10% by volume with the balance of the gas mixture consisting of nitrogen for all tests to simulate the effect of oil combustion. Typically, in addition to chlorine, the feed gas consisted of, in volume percent, 74.6% nitrogen, 7.3% carbon dioxide, 8.8% oxygen, and 9.3% water. In order to obtain the desired oxygen content, it was necessary to add liquid oxygen at the rate of 6% by volume of air which is equivalent to 4% by weight to the weight of the feed. No sulfur dioxide was added to the gas stream. The charge contained 7.45% sulfide sulfur with 4.15% as sulfate prior to treatment.

Chlorine gas was injected into the gas mixture at flow rates of 18 or 36 cubic centimeters/minute, which is equivalent to 1.5% and 3% chlorine by weight of feed. The solid discharge from the shaft bottom was combined into hourly composite samples. The samples were analyzed and, together with operational data, evaluated for the efficiency of the removal of impurities. The high concentration of sulfur dioxide required for optimized volatilization is spontaneously generated from the sulfide and sulfur content of the charge by controlled oxidation and formation of sulfur dioxide. The degree of sulfide and sulfur oxidation has a controlling effect on the volatilization efficiency of the elements. This effect is more obvious at the lower chlorine addition level of, by weight, 1.5% than at the 3% level. It was found that losses of copper, silver, and precious metals increased with excessive oxidation, and further increase was observed with increased chlorine addition.

Analysis of the exit gas showed, in volume percent, 10.4% carbon dioxide, 1.9% oxygen, and 10% sulfur dioxide. Calculation based on the amount of chloride recovered from the exit gas showed that the gas stream contained an average of 2.6%, by weight of feed, of chlorine equivalent chlorides.

Table I contains the initial composition of the 5,570 grams of pellets prepared from a blend of electrostatic precipitator dusts and hydrometallurgical wastes. It also shows the assay of the resultant 4,362 gram composite sample from 24-hour continuous operation, the composition of the 32.8 grams of scrubbed solids (insoluble in water and removed by filtering), and the composition of the 15 liter water and the 12.5 liter, 4N, NaOH scrubbing solutions.

Control of the processing conditions in the aforedescribed manner provided a treated residue containing, by weight, 3.17% sulfur as sulfide and 0.63% sulfur as sulfate. The water scrubber solution contained 0.49 g/l and 4N sodium hydroxide scrubber solution contained 34.1 g/l of sulfur dioxide.

Operation of the continuous process showed that the volatilization of copper, nickel, cobalt, iron, silver, and precious metals was depressed and that these elements were retained in the solids. This action was due to the presence of sufficient sulfide sulfur in the residue at the start of treatment and, of as great importance, to the control of the process conditions so that the treated residue contained more than about 1 weight percent sulfide sulfur after treatment.

The loss of moisture and sulfur from the charge was reflected by increased percentages of the retained elements in the processed pellets. Preferential volatilization and separation was also demonstrated in the results of analyses for the solids recovered from the scrubbers.

TABLE I

| | Material Balance for 24-Hour Operation | | | | | |
|---|---|---|---|---|---|---|
| | Composition in Weight, % | | | Composition of Scrubber Solutions, g/l | | Total Volatilized, |
| Element | Feed Pellets | Processed Pellets | Scrubbed Solids | Water | 4N NaOH | Weight % |
| Cu | 7.3 | 9.26 | 6.06 | 0.0053 | 0.0012 | 0.51 |
| Ni | 5.66 | 7.22 | 0.50 | 0.0033 | 0.004 | 0.22 |
| Co | 0.205 | 0.26 | 0.03 | 0.0005 | 0.0005 | 3.24 |
| Fe | 26.20 | 33.40 | 2.63 | 0.2327 | 0.001 | 0.30 |
| Pb | 0.37 | 0.044 | 26.62 | 0.7740 | 0.001 | 98.7 |
| As | 0.097 | 0.045 | 3.89 | 0.140 | 0.0006 | 62.6 |
| Zn | 0.17 | 0.040 | 6.61 | 0.370 | 0.014 | 83.4 |
| Bi | 0.038 | 0.0062 | 2.93 | 0.0585 | 0.0007 | 87.3 |
| Mo | 0.003 | <.001 | 0.001 | 0.008 | <.001 | 79.5 |
| Cd | 0.027 | 0.0011 | 0.93 | 0.0832 | 0.002 | 99.9 |
| Sulfide* | 7.45 | 3.17 | 19.78 | — | — | |
| $SO_2$ | — | — | — | 0.0490 | 34.10 | |
| Sulfate* | 4.15 | 0.63 | 0.41 | 0.510 | 0.716 | |
| Total S | 11.60 | 3.80 | 20.19 | 1.00 | 34.82 | |
| $Cl^-$ | 0.16 | 0.030 | 3.65 | 9.60 | 0.060 | |
| | Composition in Parts per Million | | | | | |
| Ag | 75.00 | 94.64 | 31.79 | nil | nil | 0.25 |
| Au | 1.54 | 2.39 | trace | nil | nil | nil |
| Pt | 5.04 | 6.68 | trace | nil | nil | nil |
| Pd | 5.86 | 7.93 | trace | nil | nil | nil |
| Rh, Ru, Ir | 1.07 | 1.46 | trace | nil | nil | nil |
| Re | 0.84 | 0.07 | 134.65 | nil | nil | 93.9 |

*Sulfide and Sulfate reported as weight % sulfur.

EXAMPLE II

The vertical shaft furnace and equipment described in Example I were used for batch tests on pellets, prepared in the previously described manner, having the composition shown in Table II. The tests were of 6-hour duration with pellets being fed into the equipment at the rate of 60 grams every 15 minutes. The temperature within the shaft furnace was maintained between 850°–950° C. About 500 grams of pellet were maintained in the reaction zone at all times. The degree of oxidation of the residue was controlled by the amount of oxygen in the gas stream which was between about 5 to 15% by volume. The gas stream also contained, by volume, 7.5% water, 7.5% carbon dioxide, 5% sulfur dioxide, and balance nitrogen. Either 1.5 or 3.0 percent, by weight, chlorine was added to the gas stream as shown in Table II. The gas flow rate was 1900 to 2500 ml/min/500 grams of furnace charge.

These tests show the importance of maintained the sulfide level of the treated residue to be at least about 1% so that desired elements (Cu, Ag) are retained and others (Pb, As, Zn, Bi, Cd) are volatilized. The values shown in Table II for volatilization of the various elements were calculated from the change in ratio of nickel plus iron to other elements.

EXAMPLE III

Essentially the same conditions as described for Example II were used in this example except that chlorine was injected into the gas stream in controlled amounts of 0, 0.7, 1.5, and 3.0% by weight of charge weight. The results of these tests are contained in Table III and show effective volatilization of undesirable elements at the 1.5 and 3.0% chlorine levels. Although in theory only about 0.48% by weight of chlorine should be required for volatilization of Pb, As, Zn, Bi, and Cd in pellets of the compositions shown, efficient levels of volatilization are not obtained until a minimum addition level of about 1.5 weight percent chlorine is attained.

TABLE II

| EFFECT OF RESIDUAL SULFIDE CONTENT ON VOLATILIZATIN | | | | | | |
|---|---|---|---|---|---|---|
| | | Composition of Pellets After Treatment With Indicated Amount of Chlorine (In Weight Percent) | | | | |
| Ingredient | Feed Pellets | 3 | 1.5 | 1.5 | 3 | 3 |
| Cu | 7.86 | 5.4 | 7.9 | 8.5 | 9.9 | 9.9 |
| Ni | 6.20 | 7.9 | 7.3 | 7.7 | 8.0 | 7.8 |
| Fe | 27.4 | 34.5 | 33.4 | 33.0 | 34.6 | 33.7 |
| Pb | 0.40 | 0.076 | 0.196 | 0.145 | 0.014 | 0.014 |
| As | 0.097 | 0.037 | 0.066 | 0.053 | 0.0076 | 0.013 |
| Zn | 0.17 | 0.18 | 0.204 | 0.196 | 0.044 | 0.026 |
| Bi | 0.037 | 0.021 | 0.029 | 0.018 | 0.003 | 0.0027 |
| Cd | 0.028 | 0.058 | 0.008 | 0.0056 | 0.002 | 0.002 |
| Ag | 0.008 | 0.0003 | 0.002 | 0.003 | 0.011 | 0.011 |
| Sulfate* | 4.1 | 1.2 | 0.9 | 0.8 | 0.7 | 0.2 |
| Sulfide* | 8.1 | 0.0 | 0.2 | 0.6 | 1.1 | 4.6 |
| Total Sulfur | 12.2 | 1.2 | 1.1 | 1.4 | 1.8 | 4.8 |
| | Percent Volatilization (calculated) | | | | | |
| Cu | | 45.6 | 16.6 | 14.7 | 0.6 | Nil |
| Pb | | 84.9 | 59.5 | 70.1 | 96.8 | 97.1 |
| As | | 69.9 | 43.8 | 55.0 | 93.8 | 89.3 |
| Zn | | 17.0 | 0.9 | 4.4 | 79.6 | 87.6 |
| Bi | | 55.1 | 35.2 | 59.9 | 93.6 | 94.6 |
| Cd | | 83.1 | 75.5 | 84.6 | 94.5 | 94.0 |

TABLE II-continued

| EFFECT OF RESIDUAL SULFIDE CONTENT ON VOLATILIZATIN | | | | | |
|---|---|---|---|---|---|
| Ag | 99.7 | 76.3 | 69.3 | Nil | Nil |

*Sulfide and Sulfate reported as weight % sulfur.

TABLE III

EFFECT OF CHLORINE ON VOLATILIZATION

| Ingredient | Feed Pellets | Composition of Pellets After Treatment with Gas Stream Containing Indicated Amount of Chlorine (In Weight Percent) 0 | 0.7 | 1.5 | 3.0 |
|---|---|---|---|---|---|
| Cu | 7.86 | 9.7 | 9.8 | 9.9 | |
| Ni | 6.20 | 7.4 | 7.5 | 7.7 | 7.8 |
| Fe | 27.4 | 33.4 | 32.8 | 32.2 | 33.0 |
| Pb | 0.40 | 0.32 | 0.10 | 0.071 | 0.014 |
| As | 0.097 | 0.075 | 0.045 | 0.035 | 0.003 |
| Zn | 0.17 | 0.21 | 0.11 | 0.074 | 0.025 |
| Bi | 0.037 | 0.04 | 0.010 | 0.0086 | 0.002 |
| Cd | 0.028 | 0.02 | 0.007 | 0.0033 | 0.002 |
| Ag | 0.008 | 0.0097 | 0.010 | 0.010 | 0.011 |
| Sulfate* | 4.1 | 0.5 | 0.6 | 0.4 | 0.7 |
| Sulfide* | 8.1 | 2.2 | 2.4 | 2.1 | 1.1 |
| Total Sulfur | 12.2 | 2.7 | 3.0 | 2.5 | 1.8 |
| | Percent Volatilization (calculated) | | | | |
| Cu | | <1.0 | <1.0 | <1.0 | <1.0 |
| Pb | | 34.7 | 79.2 | 85.1 | 97.3 |
| As | | 36.4 | 61.3 | 69.7 | 93.8 |
| Zn | | Nil | 44.3 | 63.7 | 87.9 |
| Bi | | 10.9 | 77.5 | 80.5 | 93.6 |
| Cd | | 41.0 | 79.1 | 90.0 | 94.4 |
| Ag | | <1.0 | <1.0 | <1.0 | Nil |

*Sulfide and Sulfate reported as weight % sulfur.

Observation of the reaction zone during continuous operation has shown the formation of two distinct zones within the reaction vessel. The first zone develops close to the oxygen and chlorine gas impact area and is relatively oxidizing. The temperature rises about 50° to 100° C higher (although not exceeding about 1150° C) in this zone than in other parts of the reaction bed and copper loss is high. The following reactions, written for copper but also representative of the other volatile elements, are believed to occur:

$$CuS + 1\text{-}\tfrac{1}{2}\, O_2 \rightarrow CuO + SO_2 \quad (1)$$

$$2CuO + Cl_2 \rightarrow O_2 + 2\, CuCl \text{ (volatile)} \quad (2)$$

A reducing zone develops above the oxidizing zone due to the diminishing oxygen content of the process gas which has just reacted with sulfur. As a consequence, the ratio of $SO_2/O_2$ in the gas phase approaches the range where conditions favor the reduction of the volatile copper chloride converting it to oxide or to metallic form. The reactions believed to occur in this reduction zone follows:

$$4CuCl + 2H_2O + O_2 \rightarrow 4HCl + 4CuO \quad (3)$$

$$2CuCl + SO_2 + H_2O \rightarrow 2HCl + SO_3 + 2Cu^{\circ} \quad (4)$$

$$2CuCl + CuS + H_2O + O_2 \rightarrow 2HCl + SO_2 + Cu_2O + Cu^{\circ} \quad (5)$$

During initial start up of the process (i.e., about the first 5 hours), it has been observed that the copper content of the processed pellets is considerably lower than the copper content of later processed pellets even though the process gas does not show the presence of large quantities of volatilized copper. Although the exact mechanism is not precisely understood and without being bound to any particular theory, it is believed that the process is dependent upon the concentration of copper in the upper reducing zone, which in turn is controlled by the presence of sulfide sulfur in an amount of at least about 1.5%, by weight. Under controlled roasting conditions, this is believed to cause the observed change in the order of volatilization.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and appended claims.

I claim:

1. A process for treating a finely divided residue containing at least about 1.5%, by weight, of sulfur and at least one metal value from the group consisting of copper, silver, cobalt, iron, nickel, gold, and precious metals to remove therefrom at least one impurity from the group consisting of Cd, Bi, Re, Pb, Mo, Sn, Sb, Zn, and As which comprises: pelletizing said residue; and heating said pelletized residue at a temperature of about 800° C to about 1150° C in an atmosphere containing chlorine in an amount of about 0.1 percent to about 5 percent, by weight, of said residue and about 8% to about 20% by volume of sulfur dioxide to volatilize said impurities and provide a treated residue containing at least about 1 weight percent sulfur enhanced in said metal value content.

2. A process as defined in claim 1, wherein said finely divided residue contains sulfate in an amount, in weight percent, less than about $$(\text{sulfur})/(0.3) - 4.$$

3. A process as defined in claim 2, wherein said atmosphere contains chlorine in an amount of about 1.2 percent to about 3.5 percent by weight of said residue.

4. A process as defined in claim 3, wherein said atmosphere contains from about 5% to about 20% moisture by volume.

5. A process as defined in claim 4, wherein said pelletized residue is heated to a temperature of from about 925° to about 1050° C.

6. A process as defined in claim 1, wherein said finely divided residue is reacted with said atmosphere in a vertical shaft furnace.

7. A process as defined in claim 1, where said finely divided residue is reacted with said atmosphere in a rotary kiln.

8. A process as defined in claim 1, wherein said finely divided residue is reacted with said atmosphere in a fluid bed roaster.

* * * * *